US005733087A

United States Patent [19]

Gwyn

[11] Patent Number: 5,733,087

[45] Date of Patent: Mar. 31, 1998

[54] BINDER ASSEMBLY SYSTEM WITH SEPARATE GUIDE MEMBER

[76] Inventor: Bruce A. Gwyn, 1104 Falcon St., Metairie, La. 70005-4130

[21] Appl. No.: 459,411

[22] Filed: Jun. 2, 1995

[51] Int. Cl.[6] ..... B42C 9/00

[52] U.S. Cl. ..... 412/8; 412/900; 281/21.1; 156/908

[58] Field of Search ..... 412/8, 900; 281/21.1, 281/34, 19.1, 4; 156/908

[56] References Cited

U.S. PATENT DOCUMENTS

| | | | |
|---|---|---|---|
| 2,782,056 | 2/1957 | Allegretti . | |
| 3,292,951 | 12/1966 | Schoenberger . | |
| 3,739,412 | 6/1973 | Card et al. . | |
| 3,840,254 | 10/1974 | Shatzkin . | |
| 3,847,718 | 11/1974 | Watson | 281/21.1 |
| 3,957,287 | 5/1976 | Hall et al. . | |
| 4,009,498 | 3/1977 | Staats . | |
| 4,204,704 | 5/1980 | Staats | 281/21.1 |
| 4,496,617 | 1/1985 | Parker | 281/21.1 |
| 4,531,874 | 7/1985 | Voges . | |
| 4,800,110 | 1/1989 | DuCorday | 281/34 |
| 4,828,645 | 5/1989 | Van Bortel . | |
| 4,928,995 | 5/1990 | Pickering et al. | 412/8 |
| 4,958,974 | 9/1990 | Schenk . | |
| 5,078,563 | 1/1992 | Lolli . | |
| 5,120,176 | 6/1992 | Bhatia et al. | 412/8 |
| 5,156,510 | 10/1992 | Uehara | 412/8 |
| 5,246,325 | 9/1993 | Morishige et al. . | |
| 5,340,155 | 8/1994 | Podosek . | |
| 5,425,554 | 6/1995 | Lamanna | 281/21.1 |
| 5,601,312 | 2/1997 | Funkhouser | 281/21.1 |

FOREIGN PATENT DOCUMENTS

| | | |
|---|---|---|
| 9201094 | 12/1992 | Belgium . |
| 9300981 | 9/1993 | Belgium . |
| 412742A2 | 2/1991 | European Pat. Off. . |
| 2091234 | 1/1972 | France . |
| 1289821 | 2/1969 | Germany . |
| 240176A | 10/1986 | Germany . |
| 1029687 | 5/1966 | United Kingdom . |
| 2145033 | 3/1985 | United Kingdom . |
| 2197156 | 5/1988 | United Kingdom . |

OTHER PUBLICATIONS

Gallagher, John A., Insertable Book Binding Strip, Xerox Disclosure Journal , vol. 4, No. 5, Sep./Oct. 1979.

"Bindomatic 1000" brochure, date unknown.

*Primary Examiner*—David P. Bryant

*Attorney, Agent, or Firm*—C. Emmett Pugh; Pugh/Associates

[57] ABSTRACT

A cover-less binder assembly system for binding together a series of sheet materials, such as, for example, paper for business reports and the like by an office worker, with the binding typically being done along one edge using a simple, cover-less and guide-less spine (10). A separate, temporary guide (20) is temporarily provided for initially guiding the sheet material or papers into the binding spine or member to be adhered thereto, after which the combination of the spine (with the edge-inserted sheet materials) and the temporary guide are placed in a heating unit for binding the sheet materials to the spine with hot melt glue. Thereafter the bound materials are removed from the separate guide, which can thereafter be re-used in connection with other materials to be bound and a different spine. A preferred guide member includes two diverging side panels (22) forming a "V" shape leading into a trapezoidal-shaped bottom in which the spine is positioned but otherwise unattached or connected. Exemplary variations in the temporary, separate guide member are illustrated in FIGS. 7 & 8.

16 Claims, 3 Drawing Sheets

BINDER ASSEMBLY SYSTEM WITH SEPARATE GUIDE MEMBER

REFERENCE TO RELATED APPLICATION

This application relates to the same type of end product as the inventor's co-pending application entitled "Cover-Less Binder Assembly System With Temporary, Easily Removable, Side, Guide Connections" filed Apr. 19, 1995, as Ser. No. 08/409,707, the disclosure of which is hereby incorporated by reference.

1. Technical Field

The present invention relates to a binder assembly system for binding together a series of sheet materials, such as, for example, paper for business reports and the like by an office worker, with the binding typically being done along one edge using a cover-less and a guide-less spine, i.e., a spine without any binder covers or side guide sheets initially attached thereto. Even more particularly, the invention is directed to such a binder assembly system in which the spine is temporarily positioned in juxtaposition to a separate, temporary guide member for initially guiding the sheet material or papers into the binding spine or member to be adhered thereto, and thereafter the spine with the sheet material attached or bound thereto is removed away from the guide member. The guide member can thereafter, if desired, be reused in connection with another spine to guide sheet material into it, and the binding and removal steps repeated.

2. Background Art

It is a common desire in, for example, office settings, to bind sheet materials, such as, for example, a selected collection of papers, along one edge to bind the materials together for finished reports, product information, data collection, etc., and the like. To achieve this, a binding industry has been created to produce various approaches to binding the selected materials together using, for example, spiral binding, adhesive binders, pin binders, etc.

In the instance of adhesive binding, typically a plastic or metal biding strip or spine, either flexible or rigid, having a "U" shape cross-section is provided with a heat-flowable, relatively thick, adhesive strip layer located in and along its bottom, usually with back and front covers (transparent or opaque) attached along each of its side walls or edges. These covers coincidentally also serve as side guides during the sheet material insertion step, guiding the papers into the bottom interior of the binding spine, as the collection of papers is inserted down toward the binding spine. After the sheet materials are straight in the binding spine, the spine end and side edges of the materials to be bound are then subjected to localized heat by, for example, being inserted into a heater having an adjacent heating element. This causes the relatively thick, adhesive strip layer in the bottom of the binding spine to puddle and pool up and flow up and around and between the various side edges of the sheets of the inserted sheet materials, resulting in the sheet materials becoming bound together to the spine, once the adhesive is allowed to cool and again become fixed.

However, for those users who wish to use different covers for different collections of sheet material, such an approach requires the user to stock a number of spines with differing cover combinations, adding to the expense of this prior art system and sometimes resulting in much waste as covers become outdated or out of favor.

Alternatively, the covers included by the manufacturer with the spine are transparent, so that whatever cover or title page the user wanted to use would be seen through the transparent, protective cover. However, the use of such an added transparent cover further adds to the cost, without sometimes being needed or even useful. It would be ideal from a cost standpoint for the manufacturer to just provide the spines with the thick adhesive layers in them with no cover(s) attached, transparent or otherwise, and allow the user to provide whatever type of cover the user might desire as part of the selected collection or sheaf of sheet materials, whether the cover(s) be transparent, opaque, decorative, informative or otherwise. However, that creates the problem or challenge of reliably and easily inserting the side edges of the sheet materials into the relatively shallow spine interior without any side guides.

To avoid this problem, it has been recently suggested to attach temporary, side, sheet guides (similar in size to covers or smaller) to the front and back, or at least one sheet guide to one side, of each binding spine, with the temporary sheet guide(s) having perforation lines along at least part of their length in lines parallel and adjacent to the side edges of the binding spine, with the connection of each of the sheet guide(s) being along at least part of the length of the spine. In such an approach, the user supplies and uses whatever cover sheet(s) is/are desired, along with the sheet materials to be bound. After the sheet materials [with any desired cover(s)] have been inserted into the binding spine with the aid of the guide sheet(s) and adhered to the spine, the guide sheet(s) are then torn off along their perforation lines, leaving only the binding spine with its bound sheet materials [and any cover(s)] attached.

This approach is included in the subject matter of the related application Ser. No. 08/409,707 referred to above.

However, in this approach, although a vast improvement over the prior art, there is a waste of materials in the torn-away, temporary guides, which are thrown away after each binding. Additionally, there is the necessity of pre-attaching the temporary guide sheets to the spine, and the post-binding step of tearing them off and disposing of them, as well as the possibility that the guide surface(s) will become inadvertently detached prior to the use of the spine.

The present invention is designed to provide an alternative solution which avoids, or at least diminishes, these problems.

Some prior patents or publications which may be of interest are listed below:

| Patent No. | Inventor(s) | Issue Date |
|---|---|---|
| 2,782,056 | Allegretti | 02/19/57 |
| 1,029,687 (GB) | Print & Plastics | 05/18/66 |
| 3,292,951 | Schoenberger | 12/20/66 |
| 1,289,821 (GR) | Neuse | 02/27/69 |
| 2,091,234 (FR) | JPC Services | 01/14/72 |
| 3,739,412 | Card et al | 06/19/73 |
| 3,840,254 | Shatzkin | 10/08/74 |
| 3,957,287 | Hall et al | 05/18/76 |
| 4,009,498 | Staats | 03/01/77 |
| 2,145,033 A (GB) | Smith | 03/85 |
| 4,531,874 | Voges | 07/30/85 |
| 240-176-A (DD) | Inst Grafische Tech | 10/22/86 |
| 2,197,156 (UK) | Peleman | 05/88 |
| 4,828,645 | Van Bortel | 05/09/89 |
| 4,958,974 | Schenk | 09/25/90 |
| 412,742 A2 (EPC) | Schenk | 02/13/91 |
| 5,246,325 | Morishige et al | 09/21/93 |
| 5,078,563 | Lolli | 01/07/92 |
| 5,340,155 | Podosek | 08/23/94 |
| 9,201,094 (BG) | Peleman | 12/14/92 (filed) |
| 9,300,981 (BG) | Peleman | 09/21/93 (filed) |

-continued

| Patent No. | Inventor(s) | Issue Date |
|---|---|---|
| (SN 08/133,308) | Lamanna | 10/08/93 (filed) |

GENERAL SUMMARY DISCUSSION OF INVENTION

Thus, the present invention is directed to a binder assembly system for binding together a selected collection or sheaf of sheet materials, e.g., paper, including any cover(s), to a spine in which the binding spine had theretofore no cover(s) or side guide member(s), either temporarily or permanently, affixed thereto. Instead, in the present invention, the cover-less and guide-less spine is juxtaposed to a preferably re-usable guide member, which guides the binding edges of the sheet material into the interior of the spine. The spine is thereafter removed away from the separate guide member, preferably after the sheet materials have become bound to the spine.

In the juxtapositioning of the spine to the separate guide member, the spine is preferably positioned or nested within bottom part of the guide member, which will then serve as a temporary guide to guide the sheet material or papers into the binding spine to ultimately become adhered thereto. In the initially preferred embodiment, the guide member has two, preferably flexible or moveable, side, guide surfaces, preferably diverging up away from the longitudinal centerline of the spine, with the bottom portion and the entrance throat of the guide member preferably forming in cross-section a trapezoidal shape into which the spine is placed and held during the heating, adhering step in which the sheet material or papers are bound to the spine.

An important aspect of the preferred embodiment is to have the bottom edges of the side guide surfaces preferably extend at least to or a little bit past the upper edges of the spine walls to insure that the spine does not present any upwardly exposed edges on which one or more of the sheet materials might get hung up as they move down the guide member to the spine interior. Additionally, it is desirable (or the lower side walls of the separate guide member to have some inwardly directed springiness. This latter aspect can be achieved by angling the walls in and/or with a proper selection of material and/or with the use of "pop" hinges at the bottom corners of the guide member.

In the preferred arrangement, the bottom of the guide member, with the spine nested in it, is placed in, (or example, the open slot of a heating unit, while the side guide surface(s) is/are grasped in the user's hand(s). The sheet material, if not already having been inserted and guided into place in the spine, is then inserted within the confines of the side guide surfaces (if two are present) or against the inner side of the single, side guide surface (if only one is present), until all of them are properly positioned with their side edges inserted down into the interior of the spine and stacked together within the length of the spine.

Heat is then applied by the heating unit though the guide member, after with the assemblage, that is, the guide member with the nested spine with its inserted and glued sheet material, is then removed by the user by again grasping the side surface(s) in the user's hand(s) and taking the assemblage out of the heating unit. Thereafter, preferably after the adhesive has cooled and set, the spine with the glued sheet materials is slid out the end of the separate guide member, or pulled up and out of the guide member, or with a combination of such movements, the spine and sheet materials are completely removed from the guide member for ultimate use. The separate guide member is then ready to be re-used in connection with another spine and another set of sheet materials to be bound to the spine, and the process repeated again and again, until ultimately the guide member becomes worn and is replaced with another, separate guide member.

The separate guide member is relatively inexpensive and its multiple reuses more than "pays for itself" in comparison to the "tear-off" guides referred to above. The guide member can be of integral or composite structure, an example of the latter being a metal or plastic bottom with the side guide surface(s) being of attached heavy stock paper or cardboard extensions.

Additionally, a very important side benefit of the invention is that the manufacturer can package and ship spines by themselves for ultimate use by the end-users, in comparison to having to pack and ship the spines with cover(s) or temporary guide (s) attached, which complicates and greatly adds to the packaging and shipping difficulties and expense. This spines-only availability also greatly simplifies the user's stocking requirements.

Various alternatives are disclosed, including using only one, substantially upwardly extended guide surface rather than two, or having one, side guide surface extend "vertically" up while the other one (if there is another one) diverge to the side away from the "vertical"; etc. Additionally, although having a guide member which is an independent, completely separate unit, which can be easily disposed of after a number of uses, is currently preferred, the separate, side guide surfaces could be built into the heating unit or machine itself.

The spine to be used with the separate guide member can be made of plastic or metal or other appropriate material and can be either relatively rigid or flexible, if so desired.

It is thus a basic object of the present invention to use a binding system which can employ simple, cover-less and guide-less binding spines, allowing the spines to be packaged and shipped separately without the need for any attached cover(s) or temporary side guide element(s).

It is thus a further, related basic object of the present invention to provide a cover-less binding assembly for use in binding sheet materials alone one edge with the use of a simple, cover-less and guide-less binding spine which uses a temporary guide member which is separate and apart from the spine and never fixedly attached thereto, but with the spine and guide member placed in temporary juxtaposition so that the guide surface(s) of the guide member can be used to reliably guide sheet material into the interior of the spine for ultimately being bound thereto.

It is a further object of the invention to provide such a system which is relatively inexpensive and reliable in operation and easy to use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein:

FIG. 2 is an isometric, side view of a first, exemplary embodiment of the separate guide member of the invention in its open disposition for, for example, receiving the binding spine of FIG. 1 shown above it, with the direction arrows showing the spine's exemplary insertion path into the guide member; while FIG. 3 is a further isometric, side view, similar to FIG. 2, but showing the spine in place within the bottom portion of the separate guide member in a position to receive sheet material to be inserted into its interior with the guiding assistance of the two, generally opposed, side, guide surfaces of the guide member; while FIG. 4 is a still further isometric, side view, similar to FIGS. 2 & 3, but showing, not only the spine in place within the bottom portion of the separate guide member, but also showing the collection of sheet materials being inserted into the spine's interior with the guiding assistance of the two, generally opposed, side, guide surfaces of the guide member, with the side panels of the guide member providing a funneling, "V" shape, side guide surfaces into the interior of the spine, with the direction arrows showing the preferred path of insertion; while FIG. 5 is a still further isometric, side view of the completely associated selected collection of sheet materials and binder assembly (including the spine and the separate guide member) inserted into the slot of an exemplary heating unit (drawn in phantom line) for heating the adhesive in the interior of the binding spine, causing it to flow and bind all of the individual sheets of material to the spine when it cools; while

EXEMPLARY MODES FOR CARRYING OUT THE INVENTION

Figure 1:
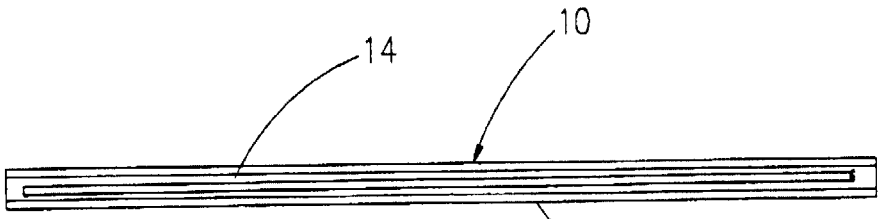
FIG. 1 is a plan view illustrating the interior side of an exemplary embodiment of the simple, cover-less and guide-less backing or binding spine used as an on-going part of the binding assembly system of the present invention, showing inter alia the heat-flow, adhesion strip to be used to secure and bind the sheet materials or papers to the backing spine after appropriate sheet material has been inserted into it and the adhesive heated and set.
Figure 2:
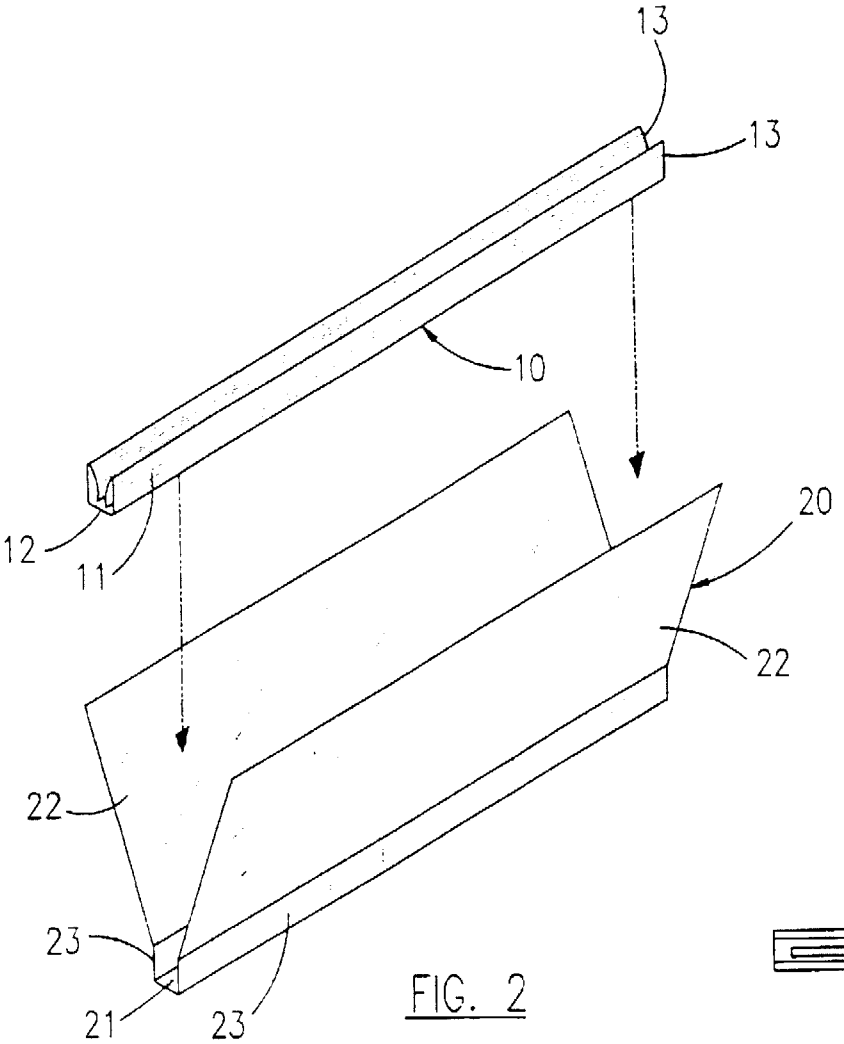

As can be seen in FIGS. 1 & 2, the exemplary, simple, cover-less and guide-less binding spine 10 of the currently preferred, exemplary embodiment of the present invention includes a body 11 having a bottom or backside 12 and two, opposed, side wails 13. The side walls 13 and the bottom 12 form a "U"-shaped interior, which "U"-shape could have either a flat base (bottom 12), as illustrated or, for further example, a curved contour. The sheet materials or paper 30 (note FIG. 4) to be bound are in use inserted or placed in this interior, ultimately to be bound to the spine 10 in a heat, binding step described more fully below in connection with FIG. 5.

A longitudinally, relatively long, extended glue area or strip 14 formed by a relatively thick layer of heat-flow-adhesive or glue extends along most, if not all, of the length of the body 11 for securing the sheaf of paper or other collected sheet materials 30 to the spine 10 in a process described more fully below. The glue strip area 14 preferably a hot melt glue in which a relatively large amount of pooling or puddling of the adhesive occurs when heated. This insures that the adhesive flows into, between and around the side edges of the papers 30 being bound in the heating step to adhere the edges of the sheet material to the spine 10.

Figure 3:
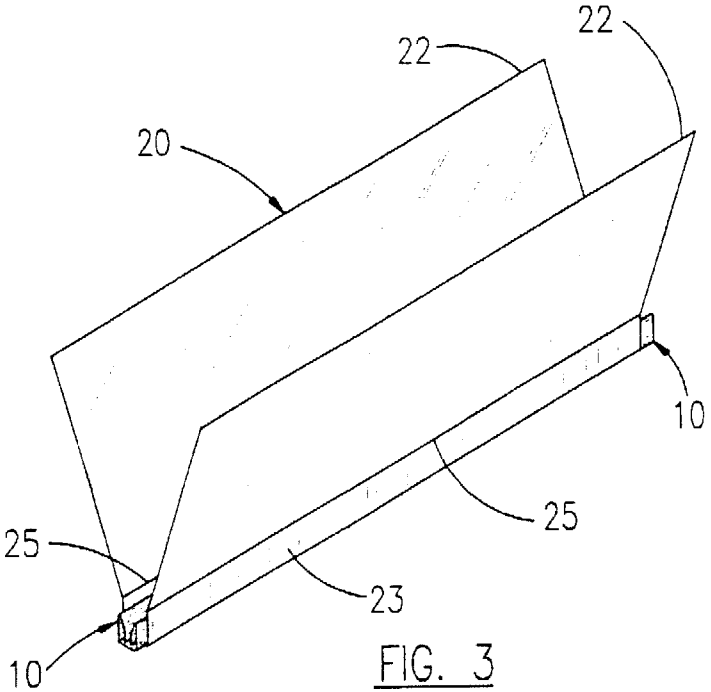

As can be seen initially in FIGS. 2 & 3, the temporary, separate sheet material or paper guide member 20 includes a bottom 21 having two, generally side-by-side, opposed sheet body panels or portions 22 connected the bottom by lower, side strips or sections 23 at a pair of parallel, bottom, fold lines 25. The side panels provide side, guide surface which in the disposition of FIGS. 2–4 form a diverging, "V" shaped configuration as illustrated. However, they preferably can bend inwardly at the fold or bend lines 25, so that they can be moved in to a true, side-by-side, "vertical" or parallel disposition, as illustrated in FIG. 5. It is further preferred, but not essential, that at least the material for the sides 22/23/25 of the guide member 20 have "memory" and thus will naturally return to its diverging disposition when inward, side pressures or forces are removed.

Figure 8:
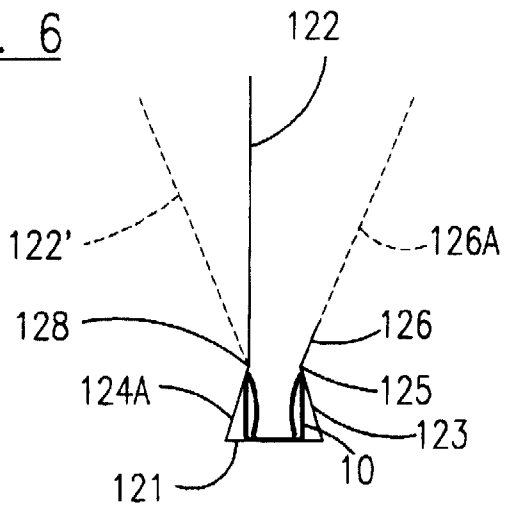
FIG. 8 is an end view of the simple, cover-less and guide-less spine illustrated in FIG. 1 temporarily inserted into the bottom portion of a still further, alternative, separate guide member, with further alternatives illustrated in phantom line.

It is also preferred that the side sections 23 and bottom 21 form a trapezoidal shape having a base greater than the width of the spine 10 but a top a little bit less than the width of the spine (note end view of FIG. 8). This avoids the presence of any upwardly presented, side edges of the spine 10 from providing a projecting surface upon which the lower edges of the outer sheet material or paper 31 could get hung up on, further insuring the insertion of all of the sheets into the interior of the spine.

In manufacture, the guide member 20 can be made from a single sheet of material, such as, for example, paper preferably of a relatively thick stock or cardboard or, alternatively, of a composite structure as described in connection with the alternative embodiment of FIG. 7.

In the preferred methodology of the invention the simple spine 10 is inserted into the bottom section of the separate guide member 20, in, for example, the manner illustrated in FIG. 2, producing the temporary combination and juxtaposition of the two as illustrated in FIG. 3, it being noted that the length of the spine 10 preferably is greater than the width of the guide member 20 (e.g. 11" vs. 10", respectively) so that it preferable protrudes out of both ends of the guide member. As an alternative to the straight down insertion of the spine 10 into the bottom of the guide member 20 illustrated by the direction arrows, the spine alternatively could be inserted from the side directly into the channel formed by the bottom portion 21/23 of the guide member, or a combination of the motions could be used.

It is noted that the spine 10 just sits in the bottom portion 21/23 of the guide member 20, with the bottom 12 of the spine merely resting on the bottom 21 of the guide member with no fixed attachments between them, with the spine bottom 12 merely resting on the guide member bottom 21 and located between the lower, side wall sections 23 of the guide member. Thus the spine 10 and the guide member 20 remain separate, unconnected elements, although related and juxtaposed together.

Figure 4:
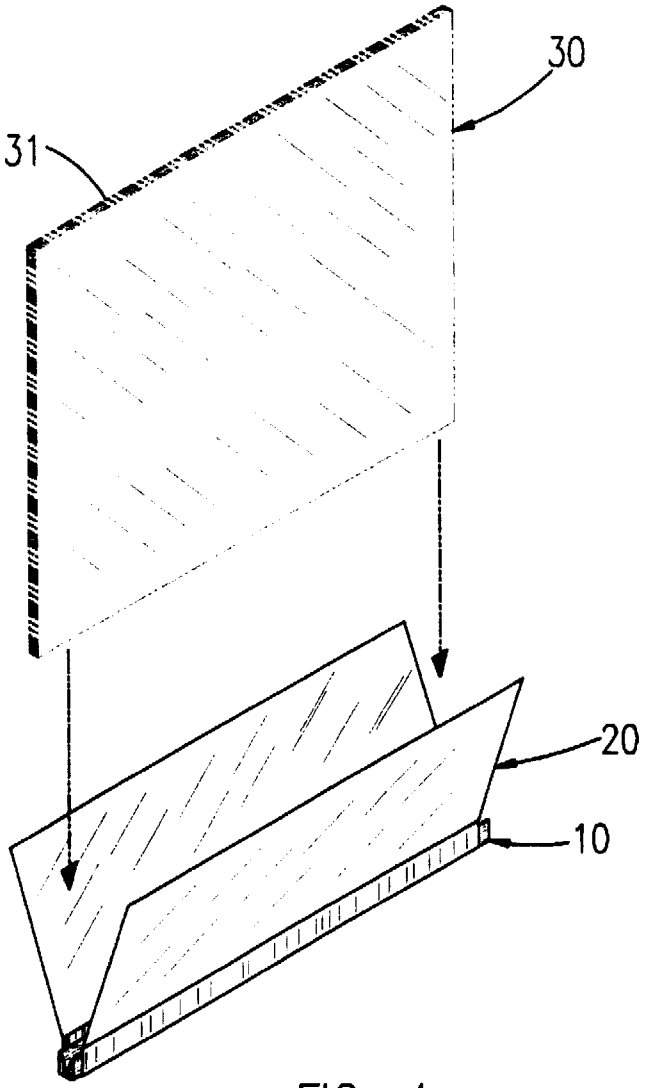
Figure 5:
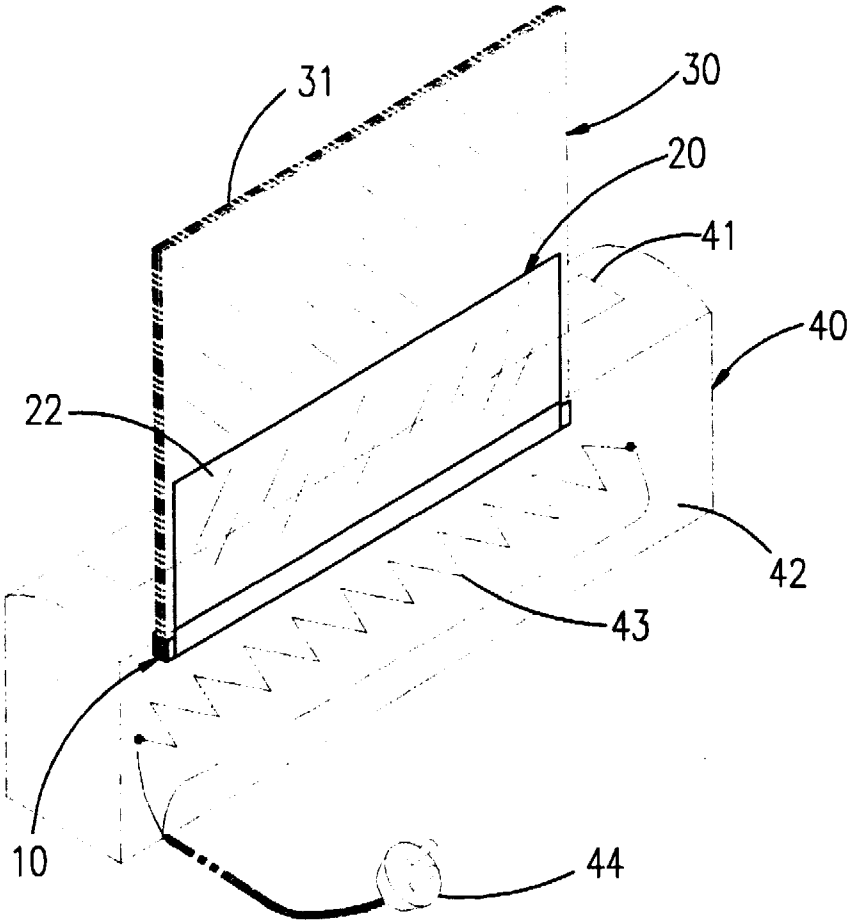

In further use and now with reference to FIG. 4, a selected collection 30 of sheet materials 31, such as, for example, a collection of individual sheets of paper 31, with or without a user provided or selected, back and/or front, decorative and/or protective cover(s), is inserted with their collective side edges inserted down into the open, "V" shaped entry formed by the side, guide panels 22 of the guide sheet or member 20. The inner or inwardly directed side surfaces of the side, guide panels 22 in turn lead down into the interior of the spine 10 and provide opposed guiding surfaces with continuously decreasing separation until they lead directly into the interior of the spine 10.

After the side edges of the selected collection 30 of sheet materials 31 have been fully inserted into the interior of the spine 10 and straighten out (if such is needed), the extended panels 22 are grasped in the user's hands and moved together by the user. The assemblage 10/20/30 is then inserted into the entry slot 41 of an appropriate heater 40 (note FIG. 5), such as, for example, the UNIBIND® model "S12", or other appropriate heating unit, to heat the binding adhesive or glue strip 14 and cause the relatively thick layer of adhesive to pool or puddle around the side edges of the inserted paper to be bound.

This heating step is accomplished by holding the assemblage by grasping the side panels 22 and pulling them toward each other at, for example, both ends between the fingers of each hand, causing them to move to a substantially parallel disposition. The spine end of the assemblage 10/20/30 is then positioned down into the slot 41 adjacent to the heating element 43. Once inserted, the assemblage can be left in place during the heating process and thereafter also for the cooling phase, if so desired.

The spine end rests on a shelf (not illustrated), and heat is applied by the electrically heated element 43 in the basic, extended body or housing 42 using, for example, an "on/off" switch (not illustrated), with the bottom 21 of the guide member 20 located between the spine 10 and the heating element 43. Power is supplied to the heating element 43 through the AC power plug 44. The heat flows through the bottom 21 of the guide member to the adhesive strip 14 of the spine 10. Thus, it is desirable that the bottom 21 be flat and the material be of reasonably good heat conductive material.

Alternatively to the sequence of the steps described above, the guide member 20 could first be placed in the slot 41 of the heater 40, and the sheet materials 31 thereafter placed in the guide member, until the materials' proximal edges entered and were set into and supported by the bottom 12 of the spine 10. However, depending on the configuration of the slot 41, particularly its with and its depth, maximum flare or divergence of the side wall panels 22 might not be achieved with certain, standard heating units, which of course could be re-designed for use with the separate guide member of the present invention. As a further alternative, a loading stand (not illustrated) could be provided to hold the guide member 20 in its most desired configuration for inserting paper or other sheet material into the spine 10, with the guide member, spine and inserted sheet material thereafter removed and placed in the heater slot 41.

In the heating step, as is well know, the adhesive strip 14 pools, puddles and flows up and around and between the side edges of the inserted papers 31. After the heater 40 is turned off and the assemblage 10/20/30 is allowed to appropriately cool, the now spread-out adhesive firmly binds the side edges of the inserted pages 31 to the interior of the binding spine 10, binding them all together.

Figure 6:
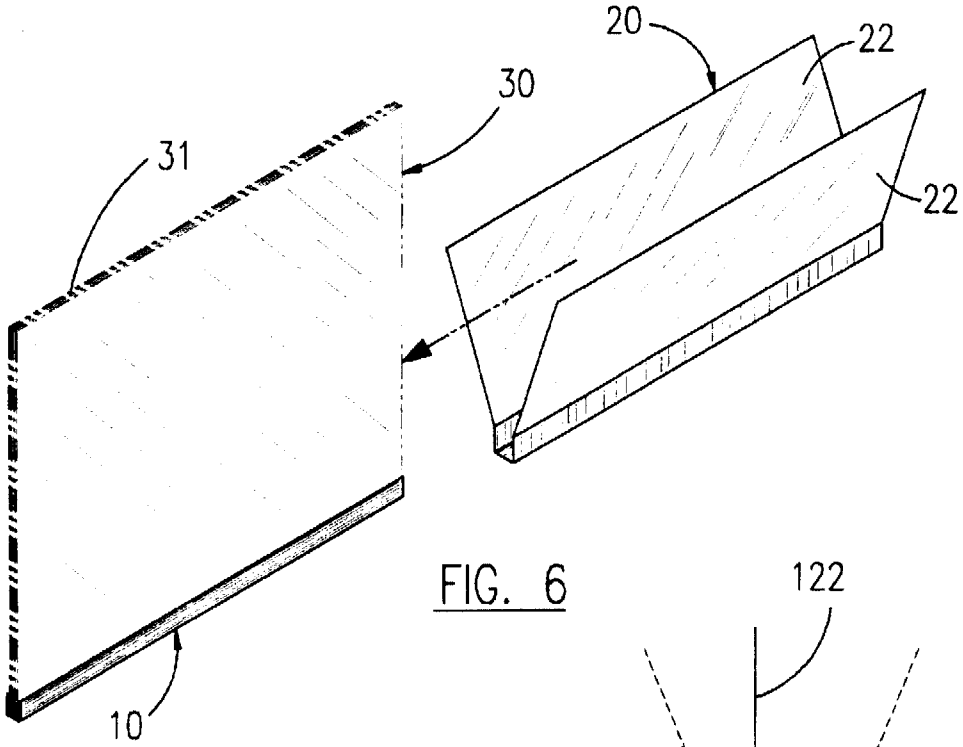
FIG. 6 is a still further isometric, side view of the bound document, including the sheet material bound to the spine, with the direction arrow showing the exemplary, side-ward path of removal of the bound document from the separate guide member; with FIGS. 2–6 illustrating in sequence the steps of binding a collection of sheet material to the simple binding spine using the separate guide member of the invention and the exemplary methodology of the invention.

Thereafter, as can be seen in FIG. 6, the bound document and the now no-longer-needed, separate guide member 20 can be easily and quickly separated from one another by pulling the spine 10 and its bound papers 31 out and, for example, to the side (note phantom lined direction arrow), causing the bound document to be removed from the separate guide member. If "pop" hinges are used (see below), they can be easily "popped" open to aid in the removal step.

Figure 7:
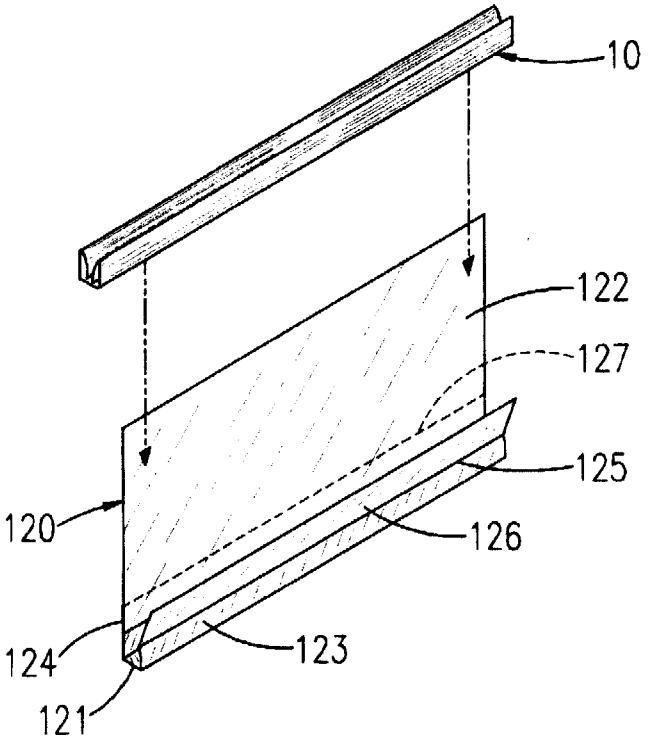
FIG. 7 is an isometric, side view, showing an alternative embodiment of the separate guide member of the invention, having a single, substantially upwardly extended side and made of composite material, with the cover-less and guide-less spine of FIG. 1 being inserted into the interior of the bottom portion of the alternative guide member following the direction arrows.

As an alternative to the particular, integrally formed guide member 20 with its two, diverging, side panels 22, the alternate guide member 120 illustrated in FIG. 7 could be used. In manufacture, the extended, side panel 122 could be compositely formed with the material for the lower portion formed by sections 121/123/124, with the former being, for example, heavy stock paper or cardboard and the latter being, for example, light metal. Additionally, rather than two, opposed, upwardly extended, side guide panels 22, only a single, extended panel 122 could be used as illustrated. Additionally, the single side panel 122 and the lower wall section 124 could be located in the same plane, making a ninety (90°) angle with the guide member bottom 121, as illustrated.

In such a situation, the opposite side of the lower portion of the guide member 120 preferably includes a diverging entry side 126, better insuring entry of the sheet materials 31 into the juxtaposed spine 10. When inserting the sheet materials 31, their bottom edges are directed against the inner surface of the extended panel 122, which then primarily serves the guidance function, with the side section 126 supplementing the final guidance at the entry portion of the interior of the juxtaposed spine 10.

Thus, like the side guide panels 22, the side guide panel 122 serves as a guide for the sheet materials 31 when the latter is being inserted into the interior of the binding spine 10. Additionally, in the step of placing the assemblage 10/120/30 into the slot 41 of the heater 40, the side panel 122 serves as a grasping surface, in similar fashion as that of the ends of the side panels 22. Thus, it can be grasped in the user's hand(s) and held with the collection 30 of sheet materials in the user's hand(s) for moving the assemblage about and positioning it where and how desired.

After the sheet materials 30, including any cover(s) provided by the user, are bound to the spine 10, the no-longer-needed guide member 120 and the bound document are separated from one another, in similar fashion to that illustrated in and described in connection with FIG. 6.

As further alternatives to the particular, integrally formed guide member 20 with its two, diverging, side panels 22, as well as the compositely formed guide member 120 and its single side panel 122, the alternate guide members 121' illustrated in full and phantom line in FIG. 8 could be used. As can be seen in the figure, rather than the ninety (90°) degree or "vertical" placement of the single panel 122 and side strip section 124, an angled side section 124A can be provided, producing the trapezoidal shape of the embodiment of FIGS. 2–6, either with the side panel 122 being "vertical" or with the side panel 122' being divergent (note phantom lined panel).

As can be seen more dearly in this figure, the trapezoidal shape with its designed narrower, top, separation distance in comparison to the greater width of the upper entry throat of the spine 10 insures that the outer pages of the sheet material 31 cannot get hung up on the upper edges of the spine sides 13 as they move toward and into the interior of the spine. It is desirable that the material of the lower side walls 123/124A have some resilient springiness to it so that they bears inwardly against toward the direction of the spine 10.

Alternatively or additionally, "pop" hinges 127 can be provided at the bottom corners of the guide member 120'. Such "pop" hinges have a tendency to pop shut when the hinged side approaches its closed disposition but can also be quickly and easily "popped" back open when so desired.

Also, the limited, diverging side section 126 could be substantially extended upwardly to produce the second, diverging, opposed, side panel 126A, producing two side panels, similar to the side panels 22.

Exemplary dimensional details for an example of the first embodiment (FIGS. 1–6) of the elements of the binding assembly system of the invention are set out below:

| Element(s) | Exemplary Dimensions |
|---|---|
| spine 10 | 11" long with a 3/16" interior depth |
| adhesive strip 14 | 10.75" long & 1/32" thick |
| guide member 20 | 12" hi × 10" width (over-all) |

Typically, the spines 10 are supplied in various widths for use with various thicknesses of the sheet material 30 to be bound. As the widths of the spines 10 vary, typically the width of the adhesive layer 14 and the side width of the guide member 20/120 will likewise vary, and the exemplary dimensions presented above are for a spine having an exemplary 1/8" width with hot melt glue being used for glue strip or area 14.

Although spines made of metal (with, for example, a covering of leather) or other relatively stiff or rigid material is currently preferred, other, possibly flexible material, such as extruded or molded plastic, could be used. Exemplary spines would be those provided by UNIBIND® Distribution USA (New Orleans, La.) made of metal, although, of course, many other types and brands of binding spines could be used. The side guide panels 22/122 preferably are made of recycled paper of, for example, sixty-seven (67#) pound Vellum Bristol stock, with the bottom portion 121/123/124 made of thin, somewhat springy metal.

The foregoing exemplary dimensions and details are, of course, subject to great variation.

It is further generally noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A method of binding a selected collection of sheet materials to a cover-less and guide-less binding spine, comprising the steps of:

a) providing a cover-less binding spine assembly having an elongated spine having a base and opposed, side walls having upper ends forming with said base a "U" shape in end-cross-section forming an interior, and having an extended length, with heat-flowable adhesive placed within the "U" shape over and along at least part of the spine's length, said heat-flowable adhesive substantially pooling when heated to flow up and around the edges of the sheet materials when located in said interior of said spine, and at least one, separate, side, guide member physically separate from but associated with and temporarily juxtaposed to said spine along at least one, side edge of a respective upper end of at least one of said side walls, said guide member having at least one substantially upwardly extended side panel providing an inner surface capable of guiding the placement of sheet material down into said interior of said binding spine, said elongated spine being easily removed from juxtaposition to said guide member; and b) juxtaposing the elongated spine to said guide member below said at least one extended side panel of said separate guide member;

c) placing one edge of the selected collection of sheet material into said spine interior using said side guide member to guide said one edge into said interior of said spine;

d) using applied heat to melt said heat-flowable adhesive while said selected collection of sheet material is inserted into said interior of said spine causing the adhesive to substantially pool and flow up and around the edges of the sheet materials and ultimately binding the sheet materials to said spine with the subsequent cooling and fixing of said adhesive;

e) removing said spine and its bound sheet materials away from said separate guide member; and f) re-using said guide member in connection with a second spine, and repeating step "b" above with said second spine and then steps "c" through "e" above to bind another selected collection of different sheet materials to said second spine.

2. The binding method of claim 1, wherein said separate guide member has a bottom and two sides, at least one of which sides is substantially extended upwardly to form said extended side panel; and wherein step "b" includes the following step:

placing said spine upon said guide member bottom between said two guide member sides below said extended side panel.

3. The binding method of claim 2, wherein said extended panel is flexibly attached to its respective guide member side and has an inherent tendency to diverge out away from its respective guide member side above and to the side of its respective guide member side; and wherein in steps "c" & "d" there is further included the step(s) of:

contacting said guide member side and pressing it in against the adjacent side of the inserted sheet materials and inserting the assemblage of said guide member, said spine and said inserted sheet materials into a heating unit.

4. The binding method of claim 1, wherein in step "e" there is further included the step of:

moving said spine and its bound collection of sheet material out the side of said separate guide member.

5. The binding method of claim 4, wherein in step "e" there is further included the step of:

moving said spine and its bound collection of sheet material, not only out the side of said separate guide member, but also in a direction parallel to the direction of elongation of said elongated spine.

6. The binding method of claim 1, wherein in step "b" there is further included the step of:

moving said spine in a downward direction into said guide member.

7. The binding method of claim 1, wherein in step "c" there is further included the step of:

moving said collection of sheet material in a downward direction into said spine interior.

8. The binding method of claim 1, wherein the selected collection of sheet materials is to include a front cover and said collection has two exposed sides, a front side and a back side, and wherein in step "c" there is further included the step of:

placing the front cover on the front, exposed side of said selected collection of sheet materials, producing in step "e" a bound set of sheet materials with a cover.

9. The binding method of claim 1, wherein the selected collection of sheet materials is to include a front cover and a back cover and said collection has two exposed sides, a front side and a back side, and wherein in step "c" there is further included the step of:

placing the front cover on the front, exposed side of said selected collection of sheet materials, and placing the back cover on the back, exposed side of said collection, producing in step "e" a bound set of sheet materials with front and back covers.

10. The binding method of claim 1, wherein said guide member has a bottom and two, relatively moveable sides, said sides each having upper and lower ends, with said guide member sides initially diverging inwardly at their lower ends and, at least one of said guide member sides diverging outwardly at its upper end, with a dividing line separating the lower ends from the upper ends, producing at their lower ends with said guide member bottom a trapezoidal shape which can have an upper width at said dividing lines less than the separation distance between said upper ends of said spine walls, and wherein in step "b" there is further included the steps of:

placing said spine into said guide member below the dividing lines; and moving said guide member side walls relative to one another, causing the guide member's trapezoidal shape to have an upper width at said dividing lines less than the separation distance between said upper ends of said spine walls, at least reducing, if not preventing, contact between said one edge of the selected collection of sheet material with either of said upper ends of said spine walls during the performance of step "c".

11. The binding method of claim 10, wherein said dividing lines are fold lines; and wherein there is further included the step of:

relatively moving the guide member side walls about said fold lines, causing the fold lines to move inwardly toward one another, decreasing their separation distance.

12. The binding method of claim 1, wherein in step "b" there is further included the step of:

placing said elongated spine in said bottom of said guide member without any attachment between the two, the bottom of said spine merely being placed resting on the bottom of said guide member.

13. The binding method of claim 1, in which a heating unit with a top slot therein is used; and wherein, in connection with steps "b" and "c", there is further included the steps performed by the end user of:

i) grasping the guide member and manually inserting said binding spine into the bottom of said guide member;

ii) holding the guide member with one hand and inserting the selected collection of sheet material with the other hand into the interior of said spine; and iii) placing said guide member through said slot into said heating unit.

14. The binding method of claim 13, wherein step "iii" is performed before step "ii".

15. The binding method of claim 1, wherein in step "d" there is further included the step of:

applying the heat to the adhesive in said spine through the bottom portion of said guide member.

16. The binding method of claim 1, wherein there is further included the step of:

supplying to the end user a number of elongated spines in combined, packaged form, each one of which spines is to be used with the same guide member in separate binding steps by separately repeating steps "b" through "e" for each spine, using in each repeating of steps the same guide member.

* * * * *